US008225724B2

(12) United States Patent
O'Brien

(10) Patent No.: US 8,225,724 B2
(45) Date of Patent: Jul. 24, 2012

(54) FOLDING WORKSTATION

(75) Inventor: Jerry Michael O'Brien, Calgary (CA)

(73) Assignee: 1465575 Alberta Limited, Alberta (CA)

( * ) Notice: Subject to any disclaimer, the term of this patent is extended or adjusted under 35 U.S.C. 154(b) by 203 days.

(21) Appl. No.: 12/649,112

(22) Filed: Dec. 29, 2009

(65) Prior Publication Data

US 2010/0164338 A1 Jul. 1, 2010

Related U.S. Application Data

(60) Provisional application No. 61/141,972, filed on Dec. 31, 2008.

(51) Int. Cl.
*A47B 3/00* (2006.01)

(52) U.S. Cl. ..... 108/115; 108/50.01; 312/258

(58) Field of Classification Search ..... 108/115, 108/50.01, 50.02, 162, 166, 165; 52/36.1; 312/283, 290, 235.3, 315, 313, 314, 316, 312/194, 239

See application file for complete search history.

(56) References Cited

U.S. PATENT DOCUMENTS 3,527,174 A * 9/1970 Lay ..... 108/115
3,830,170 A * 8/1974 Faulstich ..... 108/162
4,437,413 A * 3/1984 O'Brian et al. ..... 108/162
4,478,467 A * 10/1984 Tyndall ..... 52/36.1
4,874,027 A * 10/1989 Boundy et al. ..... 52/36.1
5,273,169 A * 12/1993 Maglione ..... 108/162
5,429,432 A * 7/1995 Johnson ..... 312/235.3
5,558,418 A * 9/1996 Lambright et al. ..... 312/194
5,769,514 A * 6/1998 Brown et al. ..... 108/50.01
5,775,034 A * 7/1998 Logue ..... 52/36.1
5,904,104 A * 5/1999 Yu ..... 108/115
6,048,044 A * 4/2000 Biggel et al. ..... 312/258
6,053,588 A * 4/2000 Biggel et al. ..... 312/313
D425,727 S * 5/2000 Ishikawa ..... D6/425
6,082,838 A * 7/2000 Bissu-Palombo ..... 108/115
6,698,364 B2 * 3/2004 Welch et al. ..... 108/115
6,752,090 B2 * 6/2004 Schenker et al. ..... 108/115
6,752,280 B2 * 6/2004 Dye ..... 108/162
6,994,034 B2 * 2/2006 Chang ..... 108/115
6,997,115 B2 * 2/2006 Lockwood et al. ..... 108/115
7,377,078 B2 * 5/2008 Golino et al. ..... 108/50.01
7,712,849 B2 * 5/2010 Jakins et al. ..... 312/314
2001/0003960 A1 * 6/2001 Lininger et al. ..... 108/50.01
2005/0217540 A1 * 10/2005 Novak ..... 108/50.01
2005/0274300 A1 * 12/2005 Chen ..... 108/115

* cited by examiner

*Primary Examiner* — Jose V Chen
(74) *Attorney, Agent, or Firm* — Daryl W. Schnurr

(57) ABSTRACT

A portable workstation has a closed position and an operating position and can be easily installed or removed by one person. A portable workstation has two walls that are hingedly connected to either side of an elongated member with a foldable work surface hingedly connected to both walls, the work surface being shaped to provide a continuous work surface when unfolded. The workstation also has one or more foldable shelves. Preferably, all of the components of the workstation remain connected to the workstation in the closed position and in the operating position, and no assembly is required. One person can install or remove the workstation from a work area without tools.

19 Claims, 25 Drawing Sheets

FOLDING WORKSTATION

Applicant claims the benefit of U.S. Provisional Application Ser. No. 61/141,972 filed on Dec. 31, 2008.

BACKGROUND OF THE INVENTION

1. Field of the Invention

This invention relates to a workstation having a closed position in which two outer walls of the workstation are substantially parallel to one another and an operating position in which the two outer walls are substantially 90 degrees to one another. The workstation has a working surface that is folded in the closed position and unfolded in the operating position. This invention further relates to a method of installing or removing a workstation from a work area.

2. Description of the Prior Art

Workstations having open and closed positions are known, but previous workstations are too bulky when in the folded position or they do not provide the basic functions required by users such as a working surface that extends along two walls that are substantially perpendicular to one another, or they are too expensive or too complex and require major assembly and tools.

A workstation is described in the Biggel et al U.S. Pat. No. 6,053,588 when the workstation is in a closed position it has a large footprint that makes the workstation expensive to manufacture and also very expensive to transport from one location to another. The Biggel et al U.S. Pat. No. 6,048,044 describes another collapsible workstation that also has a large footprint and is complex and expensive to manufacture. Some previous workstations are not self-contained units in that they require additional attachments or wall-mounted shelving or other components other than a chair to make them workable. Other known workstations are too small when they are in the open position or too large when they are in the closed position or they do not provide sufficient privacy to a user. Other existing workstations require too much time to assemble or disassemble. The Gurin et al U.S. Pat. No. 5,584,546 describes a transportable workstation that has a large footprint even though the workstation is quite small when opened. The Pierce et al U.S. Pat. No. 5,607,214 describes a workstation that has a large footprint but is quite small when opened. It has a separate table on which the legs must be installed to set up the workstation and removed to close the workstation. The Jacobs et al U.S. Pat. No. 5,803,562 describes a workstation with a large footprint when closed and a small work area when opened.

Previous workstations often have substantial packaging materials that must be removed and disposed of each time that the workstation is set up.

SUMMARY OF THE INVENTION

It is desirable to have a workstation that can be used as a stand alone workstation with essentially all of the features of a permanently installed workstation that can be quickly closed or opened with a small footprint to make the workstation easily and inexpensively transportable. It is further desirable to have a workstation that can be opened or closed in a very brief period of time by one person acting alone without the use of tools. Portable and collapsible workstations that can be quickly installed or quickly removed, yet offer all of the amenities of a more permanent workstation.

It is an object of the present invention to provide a portable workstation that can be installed or removed from a work area by one person without tools. It is a further object of the present invention to provide a portable workstation that is collapsible into a closed position that has a very small footprint relative to the footprint when the workstation is in an open position. Preferably, the footprint in the closed position is long and narrow with the length being greater than a factor of five times the width. Still more preferably, the length of the footprint in the closed position is greater than a factor of 10 compared to the width. It is still a further object of the present invention to provide a workstation where all of the components are connected to the workstation in the closed position and in the open position and need only to be unfolded or folded to convert between the two positions. The task lamp is attached to the workstation and only requires a final adjustment and connection to a power source. The lamp bends up into place for use or down for storage.

A portable workstation that can be installed in or removed from a work area by one person comprises two walls that are hingedly connected to either side of an elongated member. The workstation has a foldable work surface with horizontal supports being hingedly connected to at least one of the two walls:

- in a closed position, the two walls are substantially parallel to one another with the workstation being folded in an orientation substantially parallel to the two walls and being substantially between the two walls. The horizontal supports are also folded to be substantially parallel to the two walls and are between the two walls, the workstation being fastened in the closed position;
- in an operating position, the walls are released from the closed position and are oriented substantially 90 degrees to one another. The horizontal supports for the work surface are pivoted away from the wall of the two walls to which they are connected to a position to support the work surface. The work surface is unfolded to rest upon the horizontal supports.

A method of installing at or removing a portable workstation from a work area by one person, the workstation having two walls that are hingedly connected to either side of an elongated member, the workstation having a foldable work surface with horizontal supports being hingedly connected to at least one of the two walls. The method comprises, commencing from a closed position, removing fasteners that are holding the two walls in a substantially parallel relationship, separating the two walls and orienting the walls to be substantially ninety degrees to one another, pivoting the horizontal supports away from the wall to which they are attached to be in a position to support the work surface, releasing the work surface and unfolding the work surface to rest upon the horizontal supports, reversing the method to move the workstation from the open position to the closed position when desired.

A method of installing at or removing a portable workstation from a work area by one person, the workstation having two walls that are hingedly connected to either side of an elongated member, the workstation having a foldable work surface with horizontal supports being hingedly connected to at least one of the two walls. The method comprises, commencing from a closed position, removing fasteners that are holding the two walls in a substantially parallel relationship, pivoting the two walls away from one another about the elongated member and orienting the walls to be vertical and substantially ninety degrees to one another, pivoting the horizontal supports away from the wall to which they are attached to be in a position to support the work surface, releasing the work surface and pivoting the work surface to rest upon the horizontal supports, reversing the method to move the workstation from the open position to the closed position when desired.

DETAILED DESCRIPTION OF A PREFERRED EMBODIMENT

Figure 1:
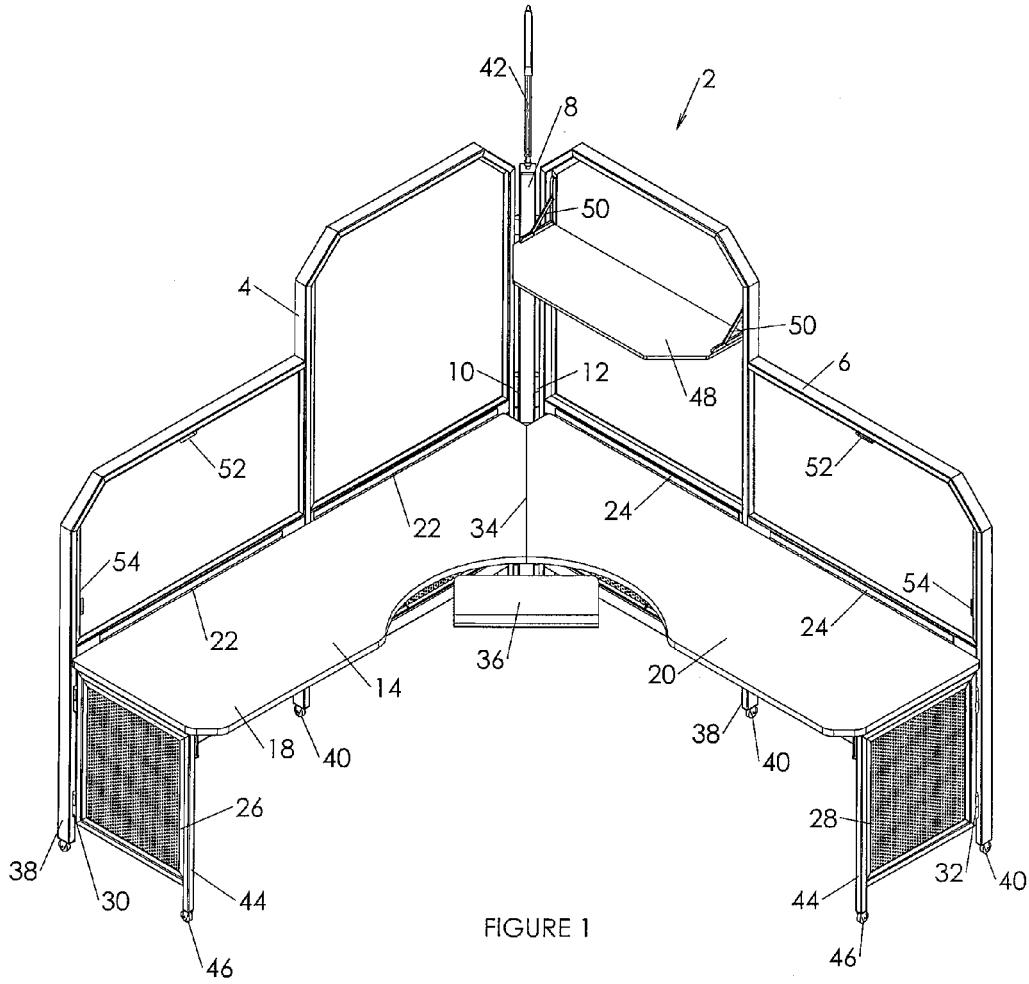
FIG. 1 is a perspective view of a first embodiment of a workstation in an operating position.

In FIG. 1, there is shown a perspective view from a front of a portable workstation 2 in an operating position. An operating position with respect to a workstation as used herein is defined to mean that the workstation is installed and ready for use in that it is ready for office equipment or other equipment to be installed. Also, a chair for a user has to be added separately and is not part of the workstation.

The workstation 2 has two walls 4, 6 that are hingedly connected to either side of an elongated member 8. The elongated member 8, shown in FIG. 1, is a post with hinges 10 connecting the left side of the post to the left hand wall 4 and hinges 12 connecting the elongated member to the right hand wall 6. The workstation 2 has a foldable work surface 14 that is divided into two sections 18, 20. The left hand section 18 is connected to the wall by hinges 22. The right hand section 20 of the work surface 14 is connected to the wall 6 by hinges 24. The hinges, 22, 24 are preferably piano hinges but other hinges are suitable. The work surface 14 is supported by horizontal supports 26, 28. The horizontal support 26 is connected to the wall 4 by hinges 30. The horizontal support 28 is connected to the wall 6 by hinges 32. There are additional horizontal supports (not shown in FIG. 1).

The two sections 18, 20 of the work surface 14 are shaped to meet along a common imaginary line 34. The imaginary line 34 is preferably linear and extends at an angle between the two sections 18, 20. The imaginary line 34 preferably extends at an angle of substantially 45 degrees with respect to each of the two walls 4, 6. A keyboard tray 36 is mounted beneath the work surface 14 and is preferably located in a channel (not shown) so that the keyboard tray can slide in and out relative to the work surface 14 and can be stored beneath the work surface when not in use. Preferably, each of the walls 4, 6 have legs 38 thereon with wheels or castors 40 located at a base of each leg 38. Preferably, the workstation 2 has a lamp 42 installed in a top of the elongated member 8. Preferably, the workstation is pre-wired so that the workstation can be plugged into a suitable electrical outlet and the lamp will be installed in the top of the elongated member 8 in use and in storage. The lamp will flex up or down between use and storage position respectively. The cord (not shown), which is converted, will extend down elongated member 8 for plugging into suitable electrical outlet. Alternatively, the lamp can be pre-wired to a recessed and covered plug at or near an outside base of the workstation. An extension cord can then be connected to the plug to power the lamp. The workstation can also be pre-wired with a plurality of outlets to power equipment that is to be used at the workstation (eg. computer and peripherals). The pre-wiring is conventional and not shown. The horizontal supports 26, 28 have legs 44 thereon with wheels or castors 46 located at the base of the legs. Each section 18, 20 of the work surface 14 is perpendicular to the wall 4, 6 respectively to which the section is connected, but the sections can be folded upward to be substantially parallel to the walls 4, 6 respectively. Similarly, the horizontal supports 26, 28 can be pivoted from the positions shown in FIG. 1 where they are substantially perpendicular to the walls 4, 6 respectively to which they are connected to a position where the horizontal supports 26, 28 are substantially parallel to the walls 4, 6.

A shelf 48 is affixed to the wall 6 by brackets 50. The shelf 48 is shown in FIG. 1 to be perpendicular to the wall 6, but the shelf 48 can be folded upward to be substantially parallel to the wall 6. The walls 4, 6 have openings 52, 54 therein for receiving fasteners (not shown in FIG. 1) when the workstation 2 is moved from the operating position shown in FIG. 1 to the closed position shown in FIG. 7.

Figure 2:
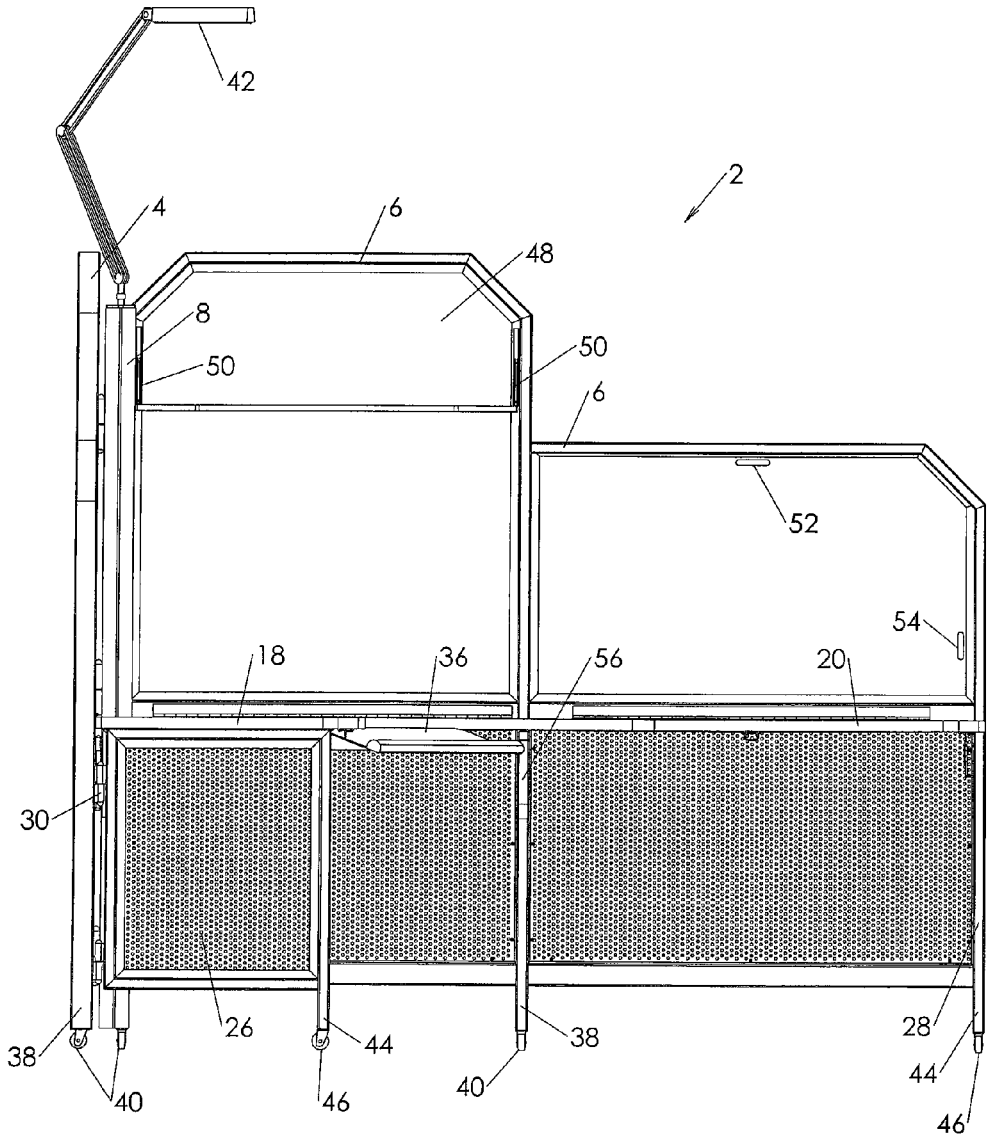
FIG. 2 is a side view of a right hand wall of the workstation of FIG. 1.

FIGS. 2 to 6, show additional views of the workstation 2 in the operating position and the same reference numerals are used in those Figures as those used in FIG. 1 for those components that are identical. In FIG. 2, it can be seen that there is a horizontal support 56, which will be described in more detail in FIG. 10, but provides support to the work surface 14 in addition to the horizontal support 28.

Figure 3:
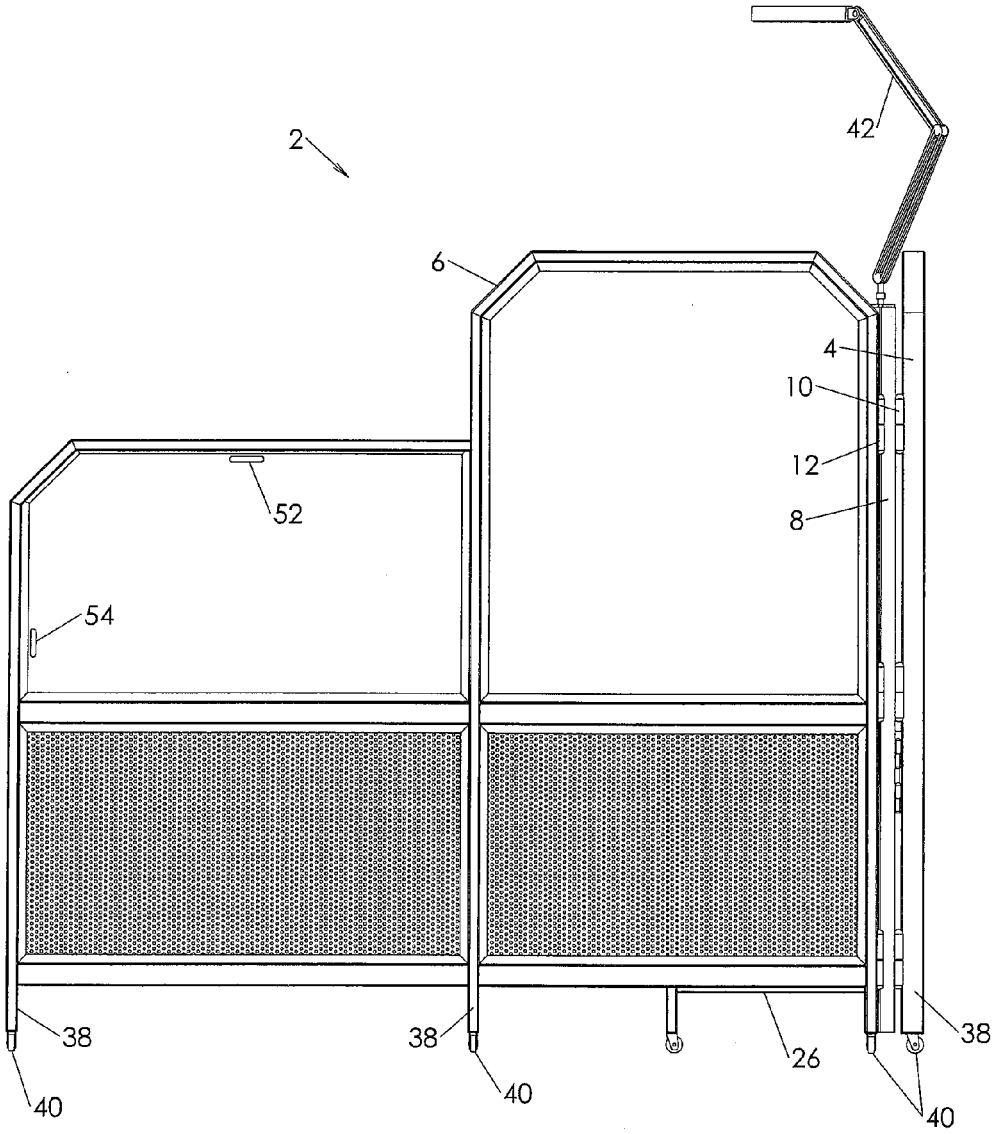
FIG. 3 is a rear view of the right hand wall of the workstation of FIG. 2.
Figure 4:
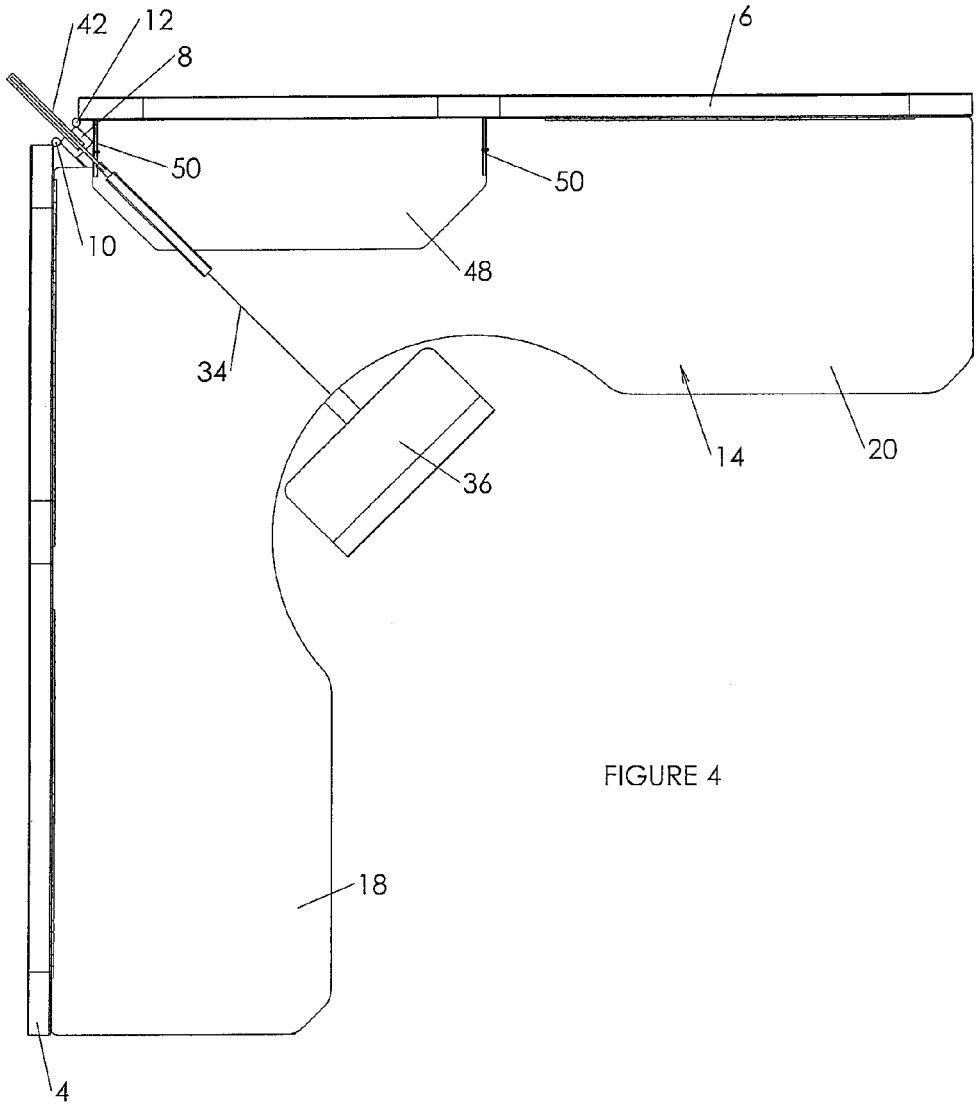
FIG. 4 is a top view of the workstation of FIG. 1 in the operating position.

FIG. 2 is a side view of the wall 6 and end view of the wall 4. FIG. 3 is a rear view of the wall 6 and an end view of the wall 4 from an opposite end to that shown in FIG. 2. FIG. 4 is a top view of the workstation 2 in an operating position. It can be seen that the walls 4, 6 are substantially 90 degrees apart from one another.

Figure 5:
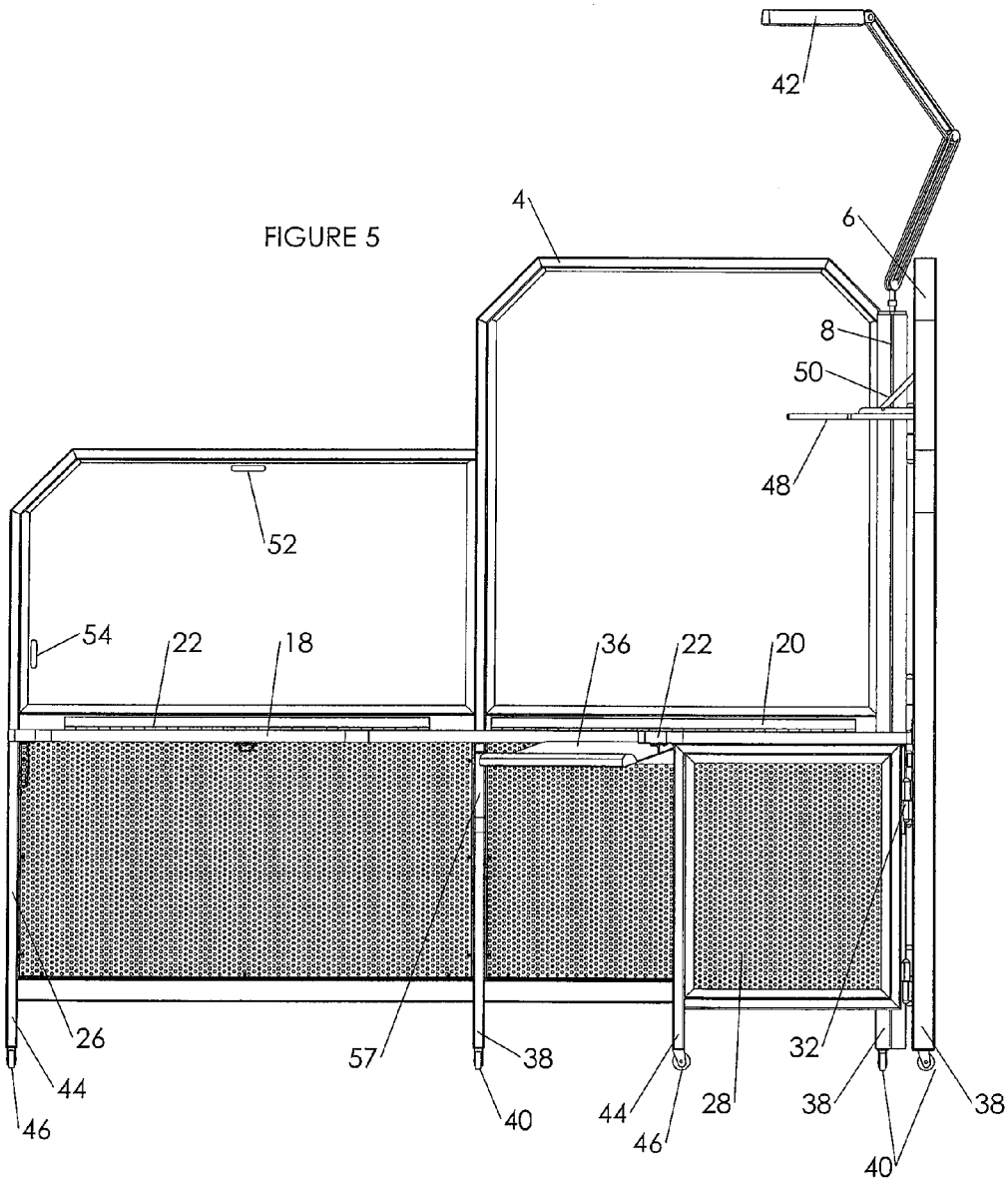
FIG. 5 is a side view of a left hand wall of the workstation of FIG. 1.
Figure 6:
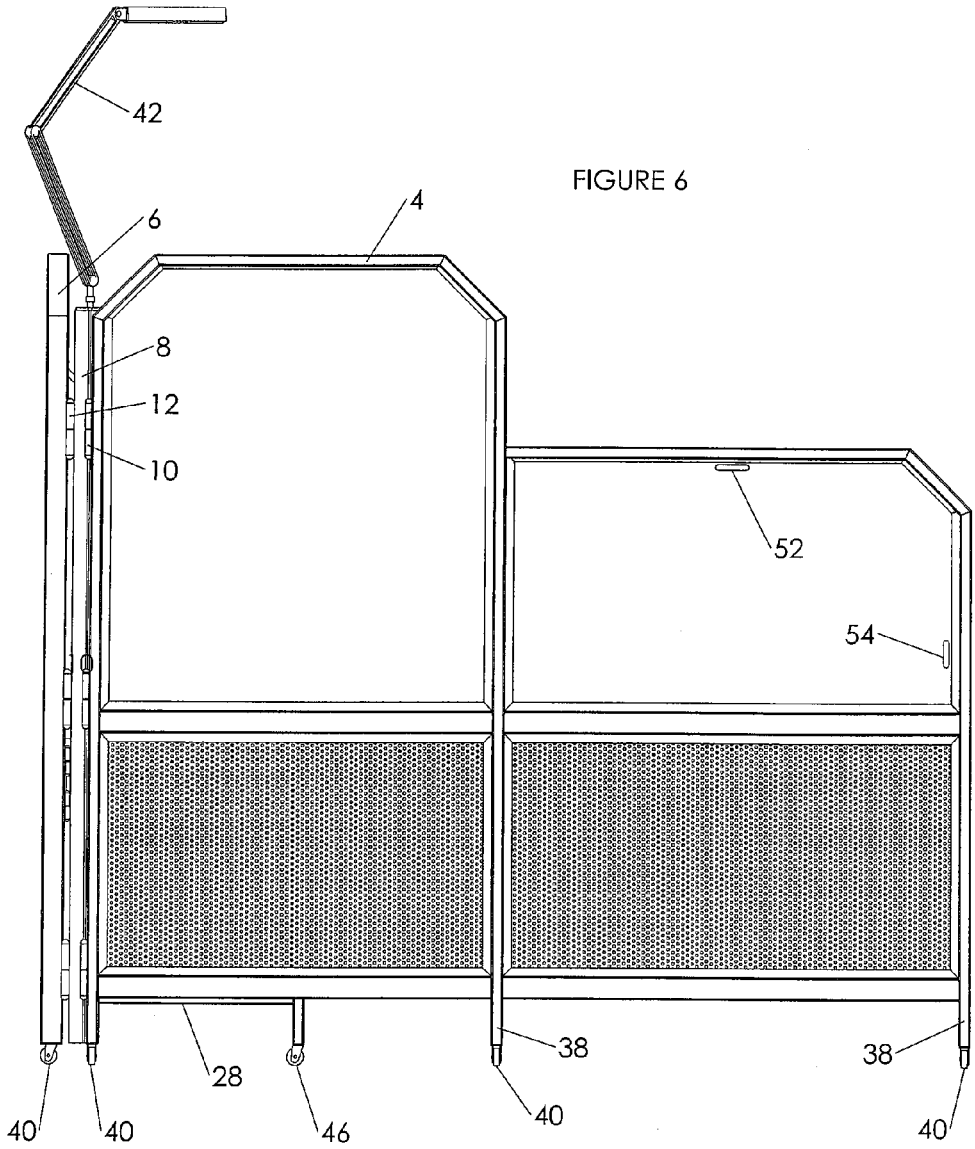
FIG. 6 is a rear view of the left hand wall of the workstation of FIG. 5.

FIG. 5 is a side view of the wall 4 of the workstation 2 and an end view of the wall 6 and FIG. 6 is a rear view of the wall 4 and an end view of the wall 6 from the opposite end to that shown in FIG. 5. FIG. 5 shows a horizontal support 57 mounted on the wall 4 to support a central portion of the left hand section 18 of the work surface 14.

Figure 7:
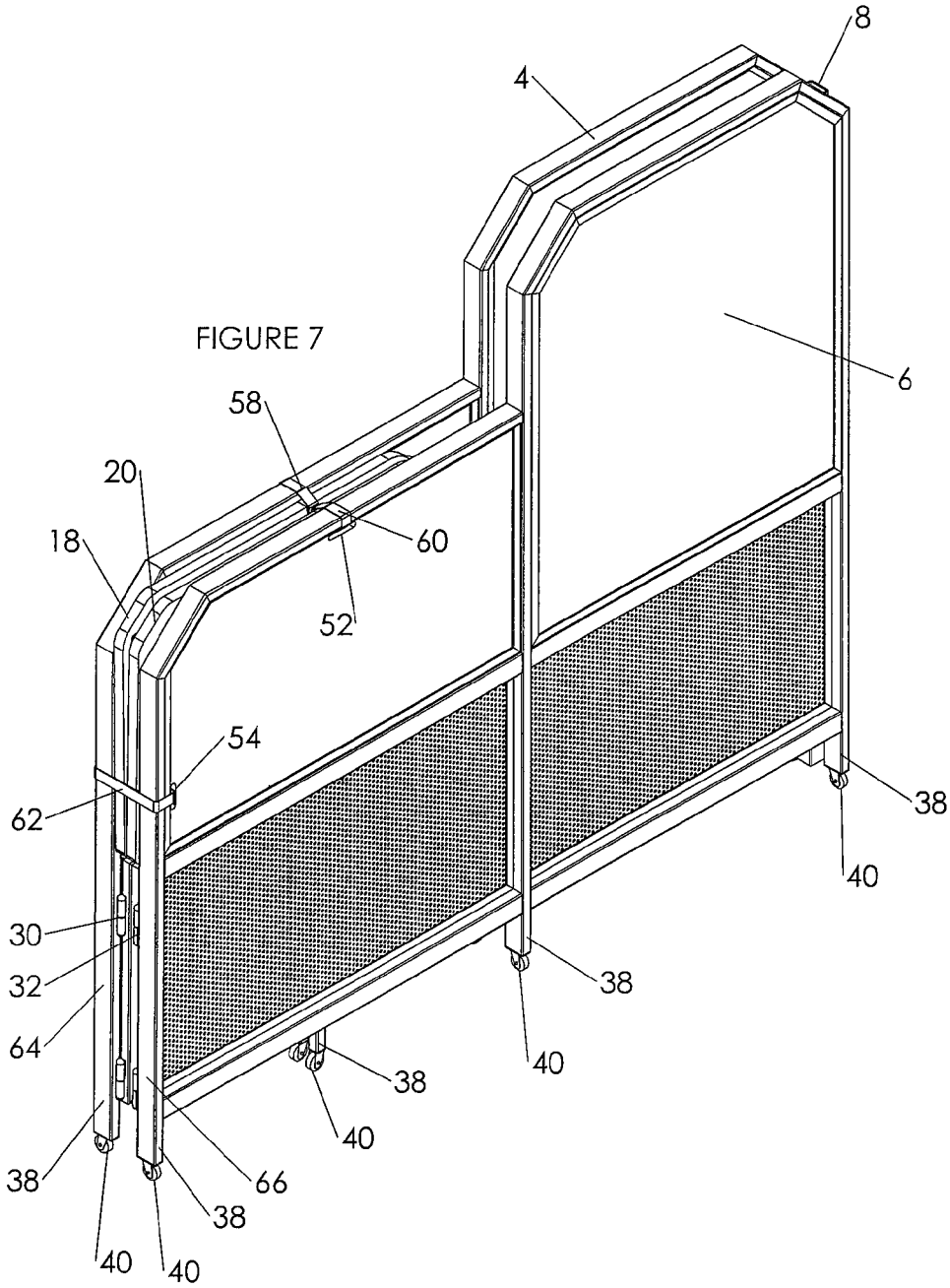
FIG. 7 is a perspective view of the workstation of FIG. 1 in a closed position.
Figure 8:
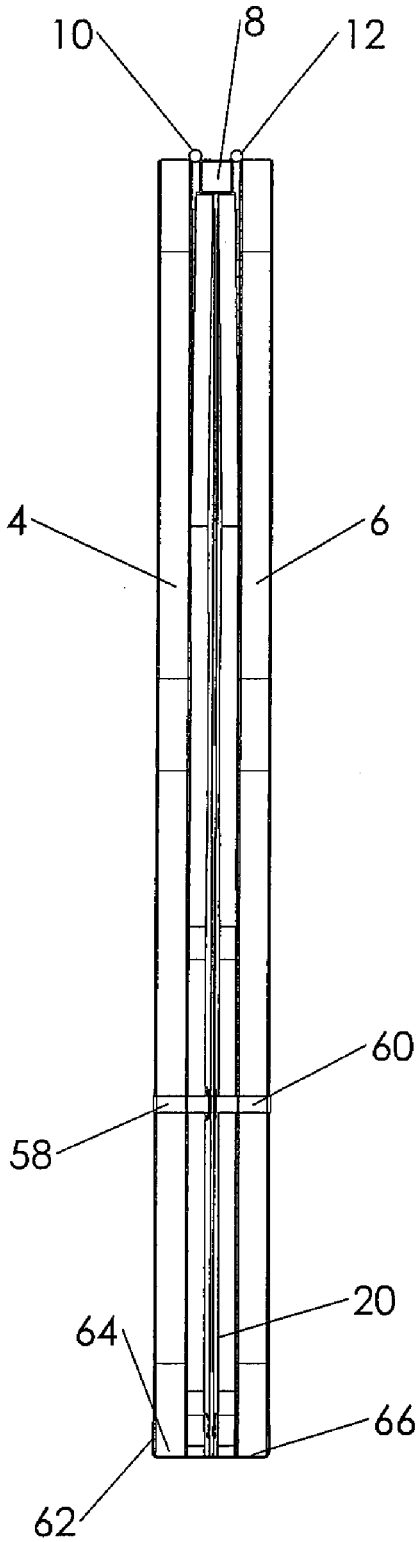
FIG. 8 is a top view of the workstation of FIG. 1 in the closed position.
Figure 9:
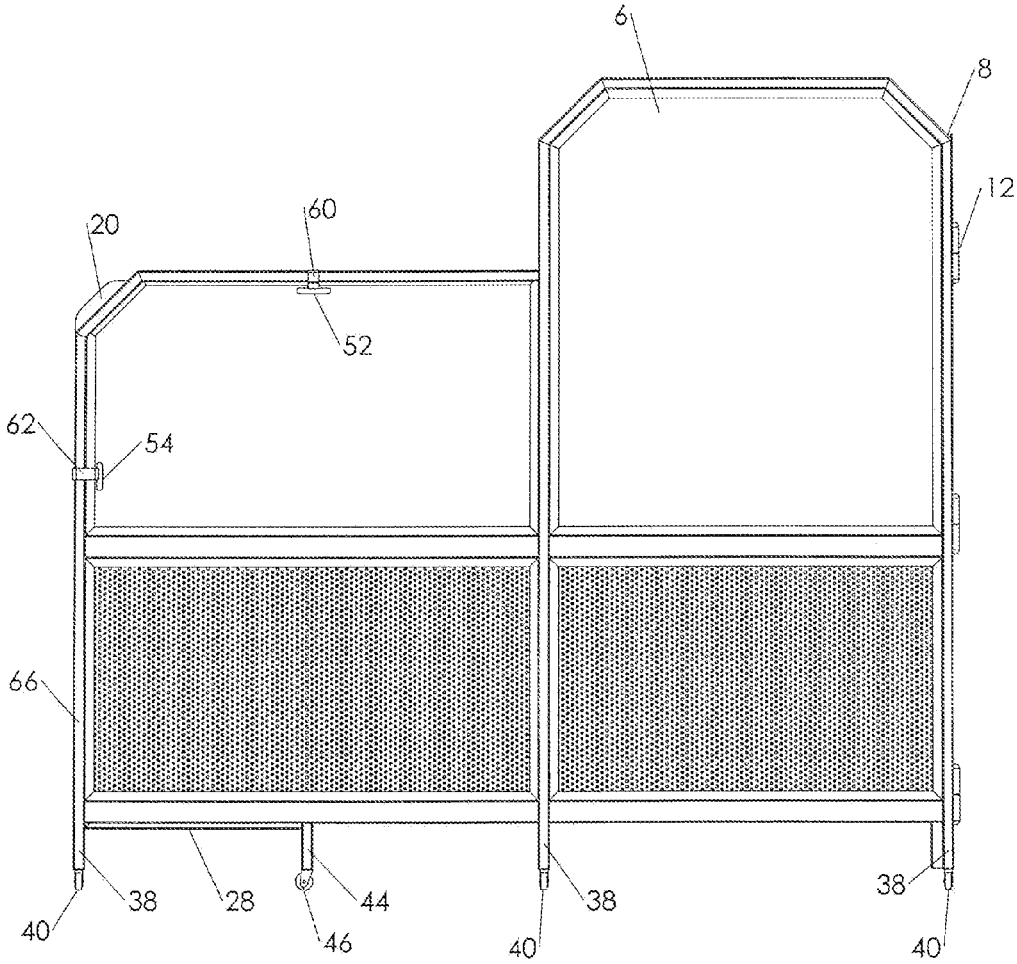
FIG. 9 is a side view of the workstation of FIG. 1 in the closed position.

FIGS. 7 to 9 show the workstation 2 in a closed position. In FIG. 7, it can be seen that the walls 4, 6 are substantially parallel to one another and the two sections 18, 20 of the work surface 14 are folded upward and are substantially parallel to the walls 4, 6. The horizontal supports 26, 28 are also pivoted to be substantially parallel to the walls 4, 6. The sections 18, 20 and the horizontal supports 26, 28 are located substantially between the walls 4, 6. The shelf 48 has also been folded up to be substantially parallel to the walls 4, 6 and is located between the two walls, but is not shown in FIG. 7. Fasteners 58, 60 hold the sections 18, 20 of the work surface 14 against the walls 4, 6 respectively to which the sections are connected. The fasteners 58, 60 extend through the openings 52 in the walls 4, 6. The sections 18, 20 of the work surface 14 can also contain openings (not shown) corresponding to the opening 52 to receive the fasteners 58, 60. Alternatively, the sections 18, 20 can have brackets (not shown in FIGS. 7 to 9) on an underside thereof to receive the fasteners 58, 60.

Fastener 62 extends through openings 54 (only one of which is shown) in the walls 4, 6 to hold the two ends 64, 66 of the walls respectively together.

In FIG. 8, there is shown a top view and, in FIG. 9, there is shown a side view of the workstation 2 in a closed position. The same reference numerals are used in FIGS. 8 and 9 as those used in FIG. 7 for those components that are identical.

Figure 10:
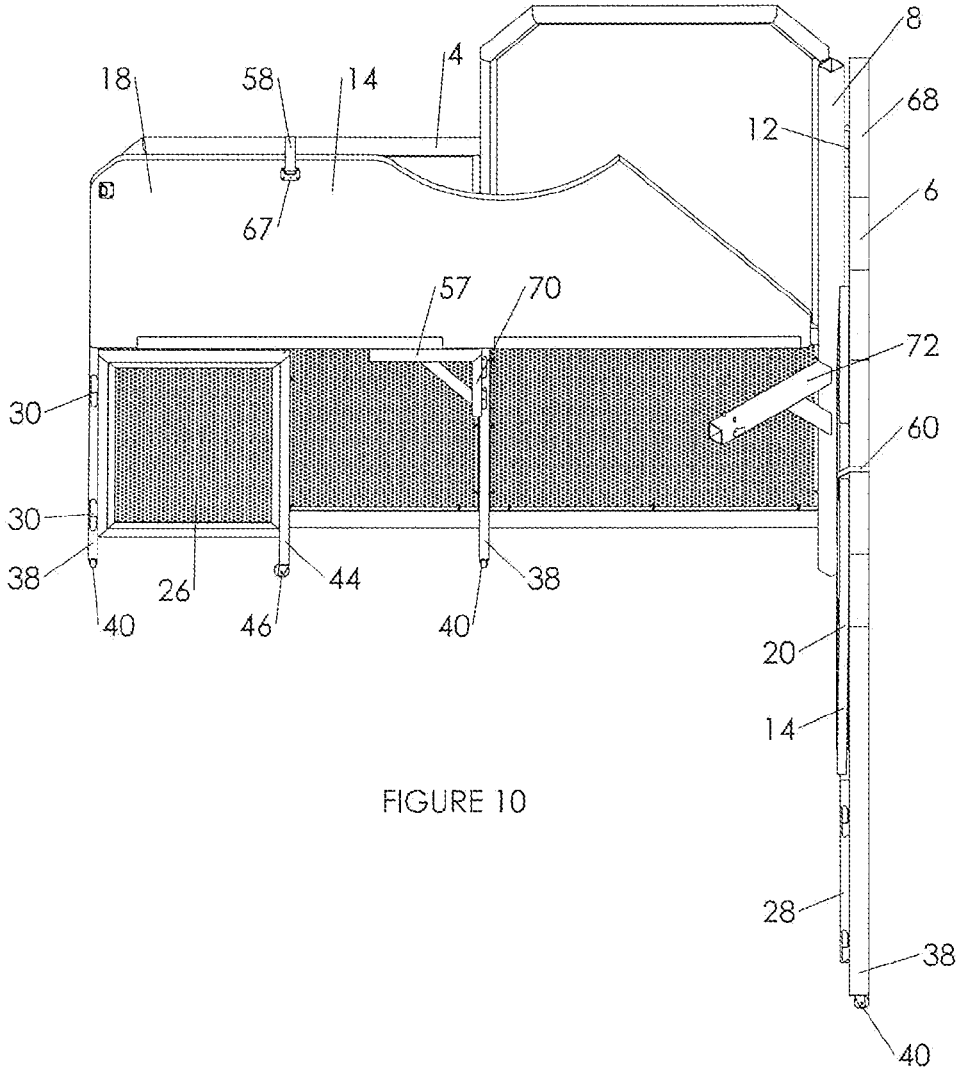
FIG. 10 is a perspective view of the workstation in FIG. 1 in a partially open position.
Figure 11:
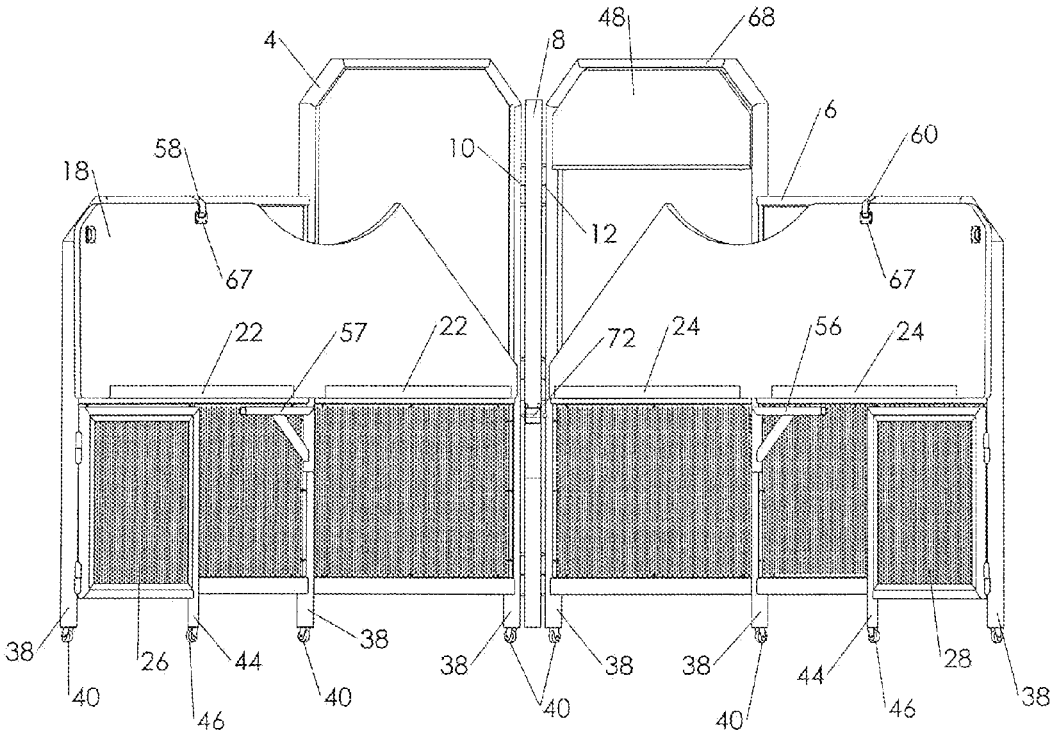
FIG. 11 is a side view of the workstation of FIG. 1 in a partially open position.
Figure 12:
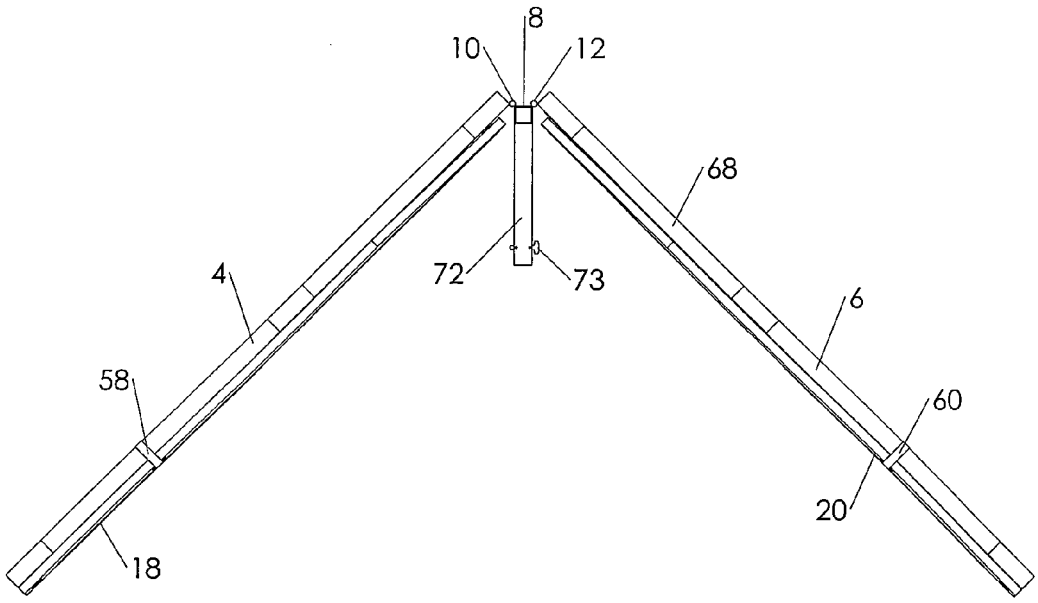
FIG. 12 is a top view of the workstation in FIG. 1 in a partially open position.

FIGS. 10 to 12 show the workstation 2 in a partially open (or it could be stated partially closed) position. FIG. 10 is a perspective view showing the section 18 of the work surface 14 in the folded position substantially parallel to the wall 4 and held in place by the fastener 58. The lamp 42 remains in the elongated member 8, but is bent down (not shown in FIGS. 10 to 12). The section 20 of the work surface 14 is also in the folded position, but is substantially parallel to the wall 6 and is held in position by the fastener 60. An underside of each of the sections 18, 20 has a bracket thereon to receive the fasteners 58, 60 respectively. The shelf 48 (not shown in FIG. 10) is also in the folded position but is hidden by a frame 68 of the wall 6. The horizontal supports 26, 28 are pivoted inward to be substantially parallel the walls 4, 6 respectively to which they are connected. The horizontal support 57 is hinged to the leg 38 by hinges 70 and the support 57 is pivoted to be substantially parallel to the wall 4 from the position shown in FIG. 2 where it is perpendicular to the wall. A horizontal support 72 is mounted on the elongated member 8 and extends inward to support the two sections 18, 20 of the work surface 14 beneath the imaginary line 34 (not shown in FIG. 10).

The keyboard tray is will be inserted into the end of the horizontal support 72 and a pin fastener 73 (see FIG. 12) is installed to hold the keyboard tray in place. No tools are required to install or remove the workstation. In the closed position, the pin fastener is released and the keyboard tray is pulled out of the horizontal support and stored in lower section of the workstation in a bottom section of one of the walls 4, 6. (not shown in the drawings). The wall 6 has a horizontal support corresponding to the horizontal support 57, but it is not shown in FIG. 10 as it is hidden by the section 20 of the work surface 14. When the horizontal supports 26 and 57 of the wall 4 are pivoted to extend perpendicular to the wall 4, they provide support to the section 18 of the work surface 14 when the work surface is in the horizontal position. Similarly, the horizontal support 72 provides support to both sections 18, 20 when the sections are in the unfolded, horizontal position. The horizontal support 72 is not hinged to the elongated member 8 as it extends at substantially a 45 degree angle to each of the walls 4, 6 when the walls are in the operating position and will extend substantially parallel to the walls when the workstation is in the closed position.

FIG. 11 shows the horizontal support 56 for the wall 6 that corresponds to the horizontal support 57 for the wall 4. The horizontal supports 26, 57 are substantially parallel to the wall 4 and the horizontal supports 28, 56 are substantially parallel to the wall 6. The sections 18, 20 of the work surface 14 are in the folded position as is the shelf 48. The horizontal support 72 extends substantially equidistant between the walls 4, 6 in FIG. 11. If the workstation 2 shown in FIG. 11 is in the process of being removed, the next step is to move the two walls 4, 6 together so that they are substantially parallel to one another. FIG. 12 is a top view of the workstation shown in FIG. 11. The walls 4, 6 are substantially 90° apart from one another. The pin 73 is shown in the horizontal support 72.

In FIGS. 13 to 25, there is shown a second embodiment of a workstation 76. The same reference numerals are used in FIGS. 13 to 25 as those used in FIGS. 1 to 12 for those components that are identical. The workstation 76 is similar to the workstation 2 except that the workstation 76 has added features.

Figure 13:
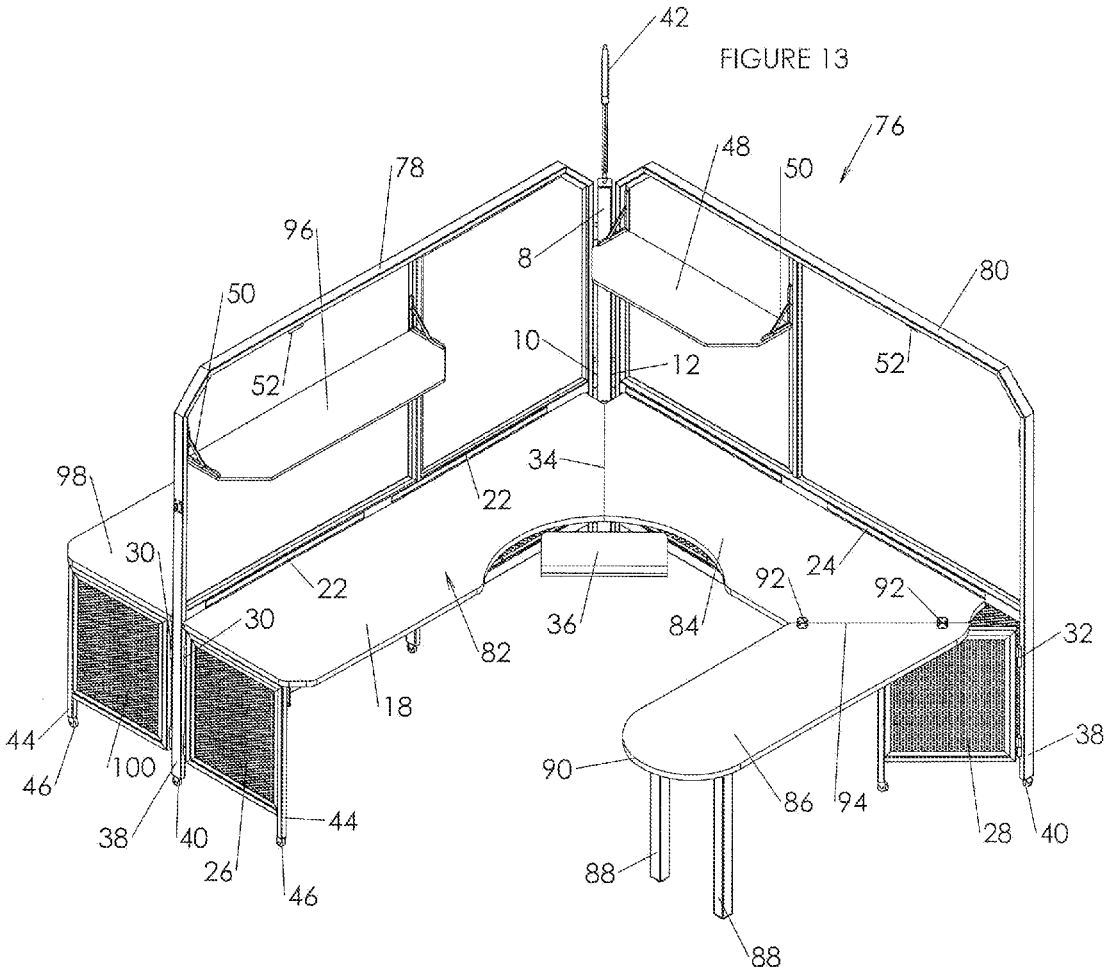
FIG. 13 is a perspective view of a second embodiment of the workstation in an operating position.

FIG. 13 is a perspective view of the workstation 76 in an operating position with two walls 78, 80 that are substantially perpendicular to one another. A work surface 82 is much larger than the work surface 14 of the workstation 2 because the work surface 82 has three sections 18, 84, 86. The section 18 is connected by hinges 22 to the wall 78, the section 84 is connected by hinges 24 to the wall 80. The section 86 is a peninsula having two legs 88 at a free end 90 is connected by hinges 92 to an outer end of the section 84 along a common imaginary line 94. The legs are hinged to be foldable when the workstation is moved to the closed position. The imaginary line 94 is angled at substantially a 45 degree angle to the right hand wall 80. The horizontal support 28 is angled to be located substantially beneath the line 94. The shelf 48 is hingedly connected to the wall 80 by the brackets 50 and a second shelf 96 is hingedly connected to the left hand wall 78 by brackets 50. On an outer side of the wall 78, there is mounted a second work surface 98 having a horizontal support 100.

Figure 14:
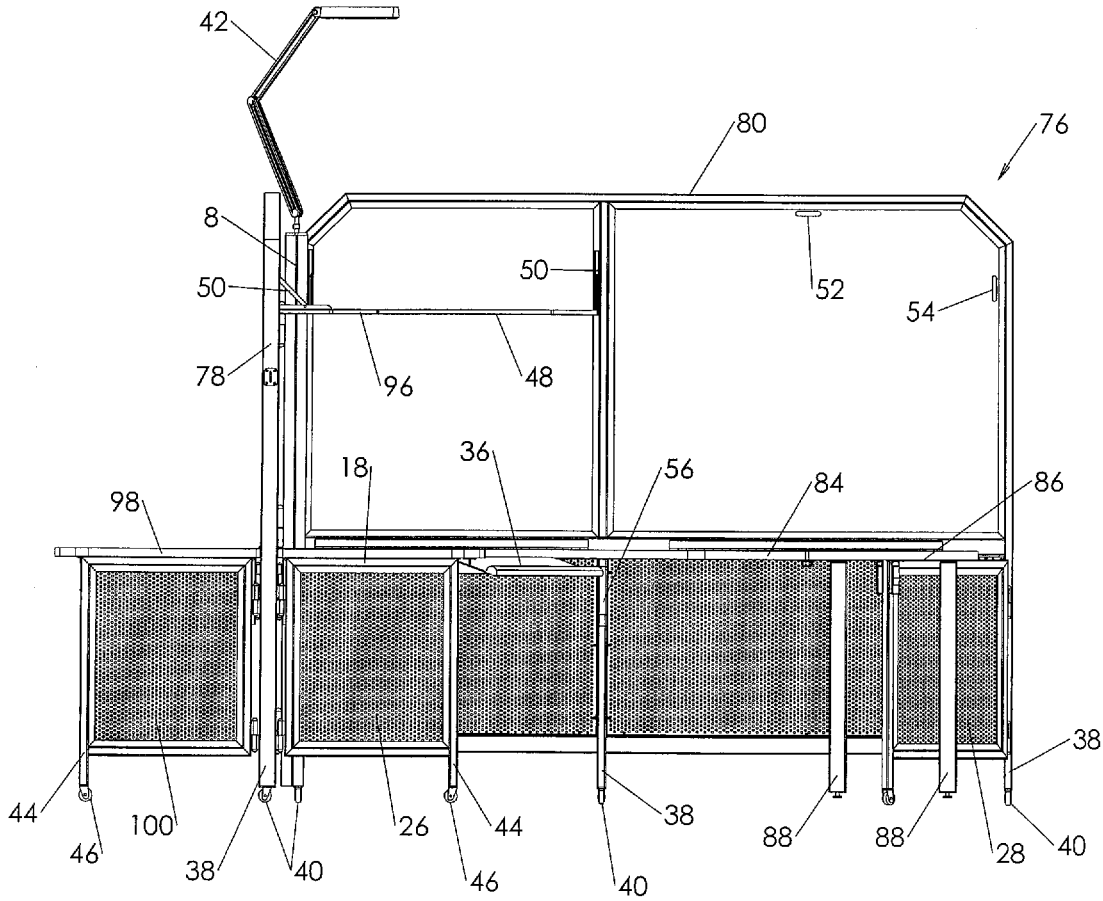
FIG. 14 is a side view toward a right hand wall of the workstation shown in FIG. 13.
Figure 15:
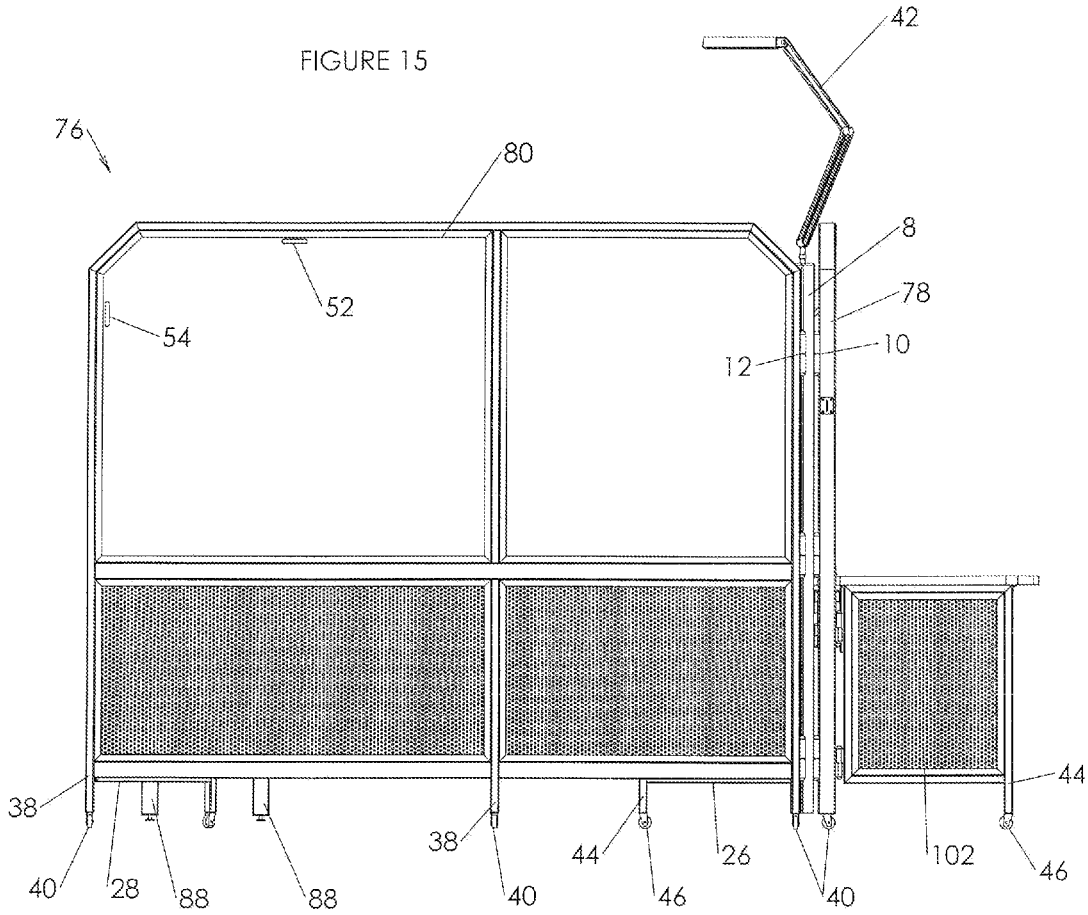
FIG. 15 is a rear view of the workstation as shown in FIG. 14.
Figure 16:
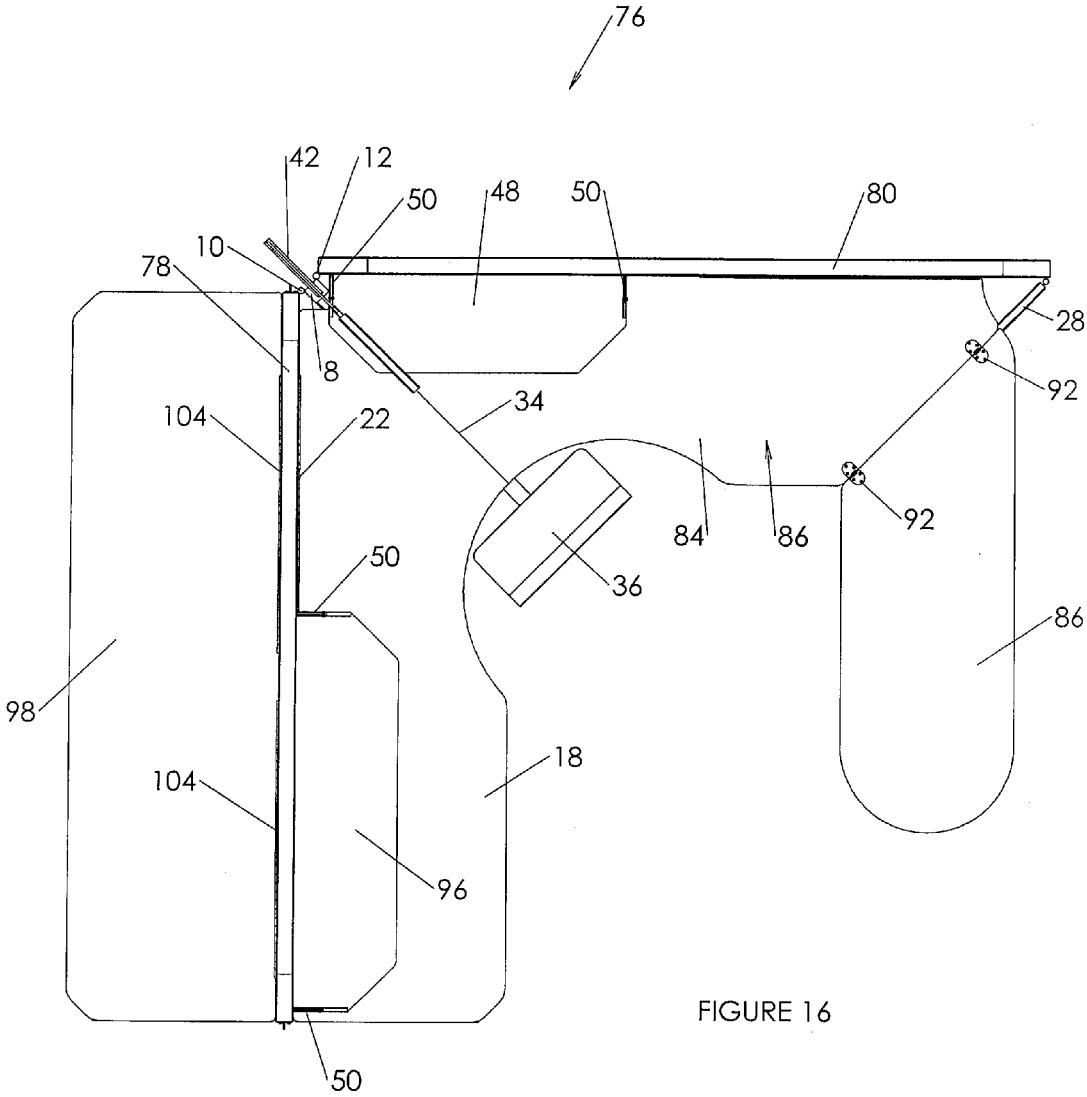
FIG. 16 is a top view of the workstation shown in FIG. 13.
Figure 17:
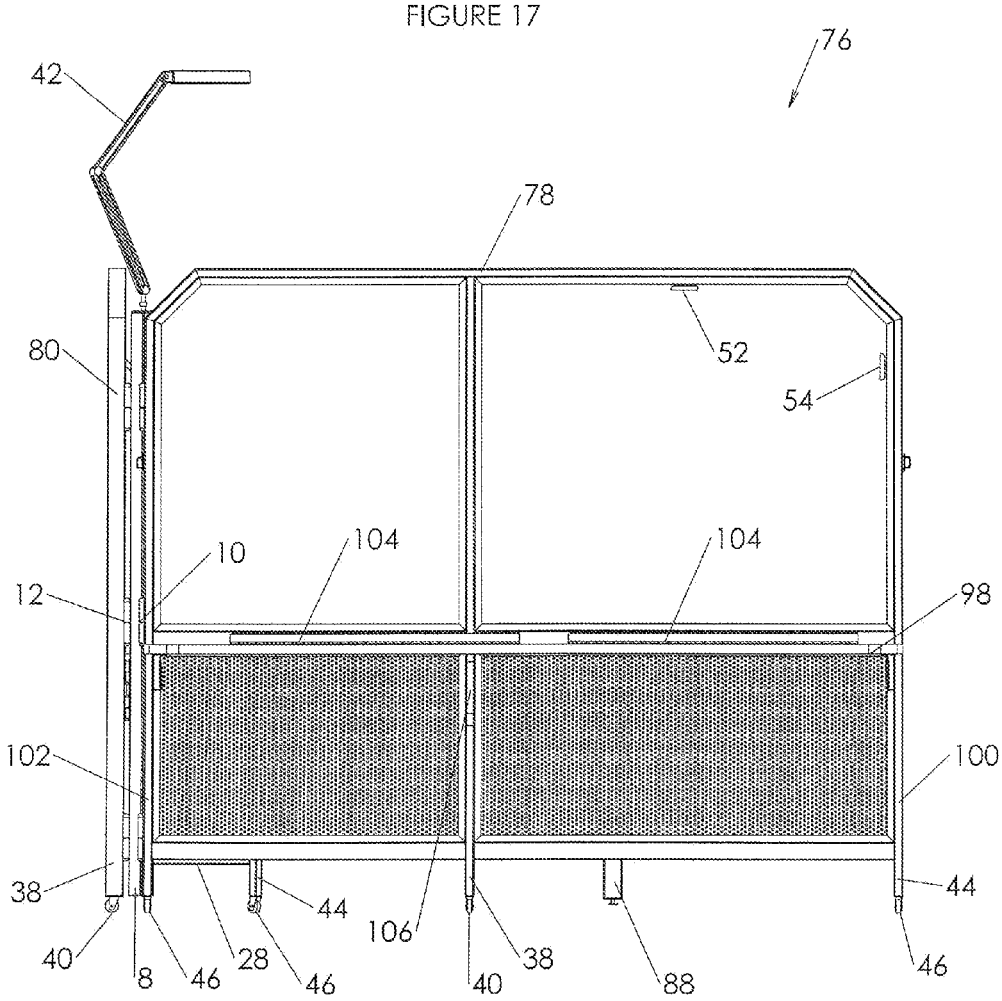
FIG. 17 is a rear view of the left hand wall of the workstation shown in FIG. 13.

FIG. 14 is a side view of the workstation 76 showing the inner surface of the wall 80 and an end view of the wall 78. FIG. 15 is a rear view of the workstation 76 showing the outer side of the wall 80 and a view of an opposite end of the wall 78. The work surface 98 has a horizontal support 102 at an end opposite to the end shown in FIGS. 13 and 14. FIG. 16 is a top view of the workstation 76 and shows the work surface 98 being connected by hinges 104 to an outer side of the wall 78. FIG. 17 is a side view of the workstation 76 viewed from outside the wall 78 with an end view of the wall 80. A horizontal support 106 is located on the leg 38 in a central area of the work surface 98 to support that central area.

Figure 18:
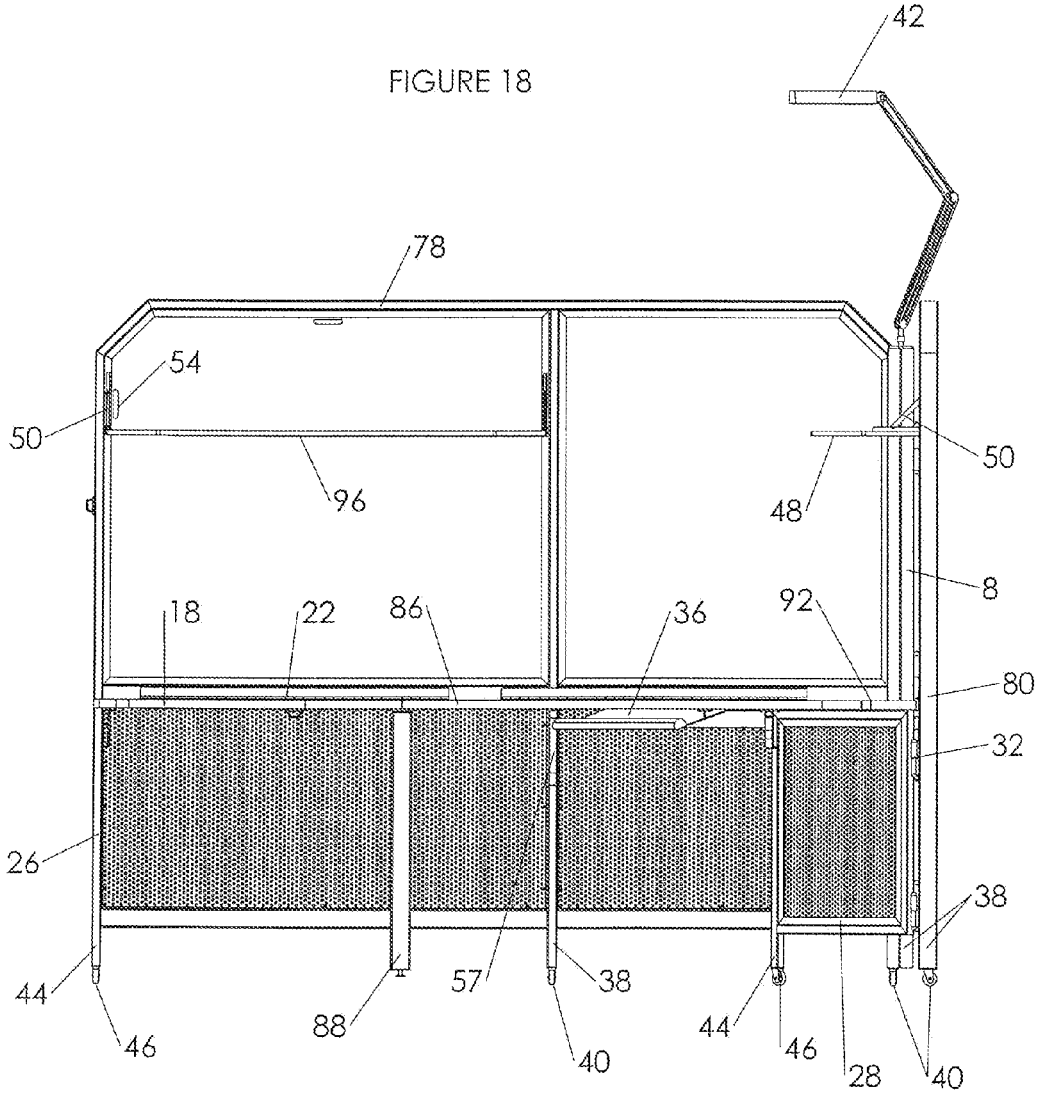
FIG. 18 is a side view of the left hand wall of the workstation shown in FIG. 14.

FIG. 18 is a side view of the workstation 76 viewed from inside the wall 78 with an end view of the wall 80.

Figure 19:
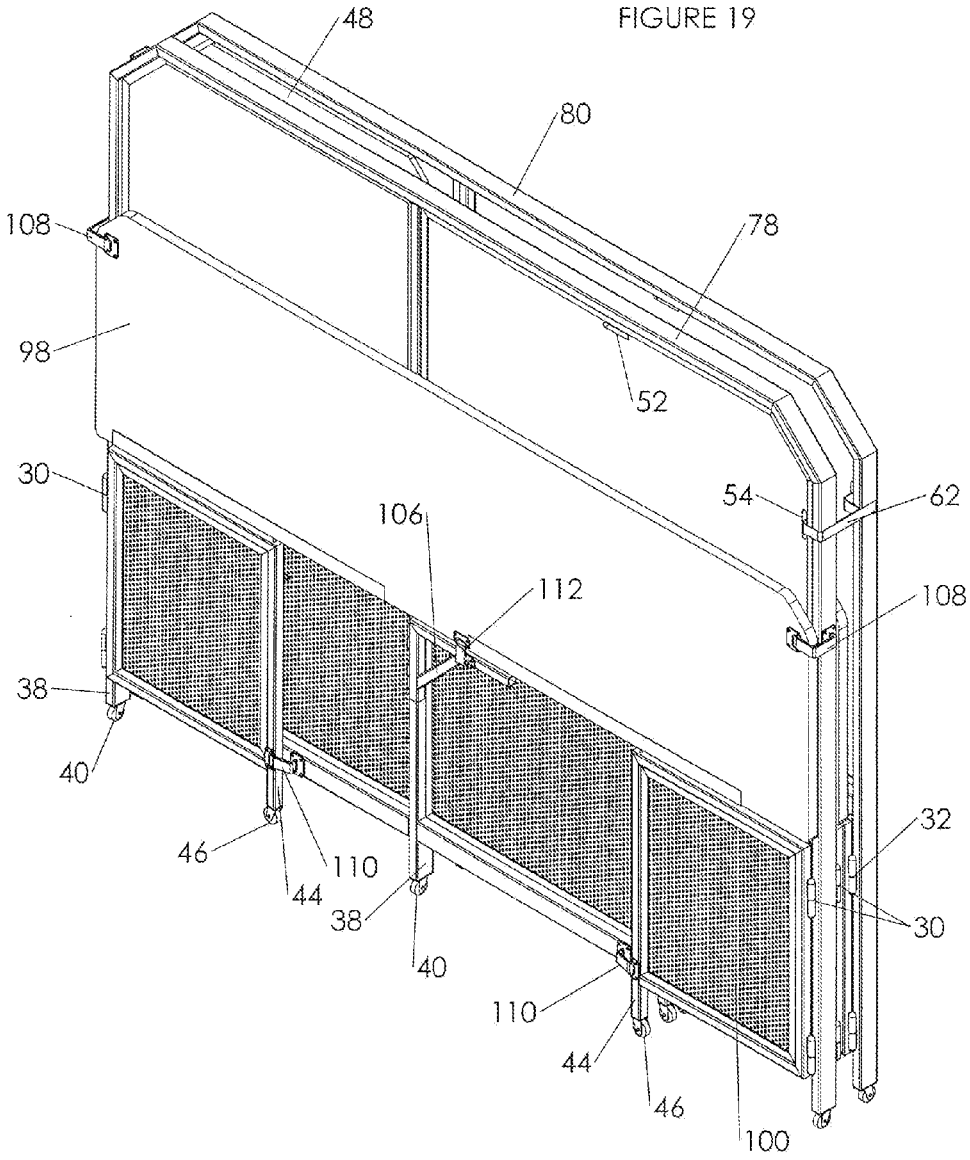
FIG. 19 is a perspective view of the second embodiment when viewed from a rear of the left hand wall shown in FIG. 13.
Figure 20:
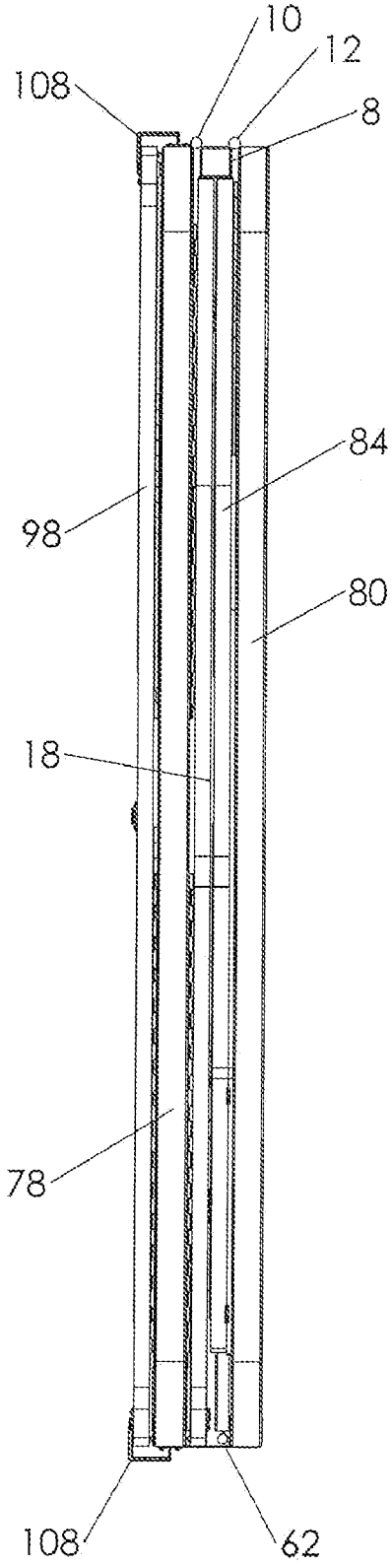
FIG. 20 is a top view of the second embodiment shown in FIG. 19.
Figure 21:
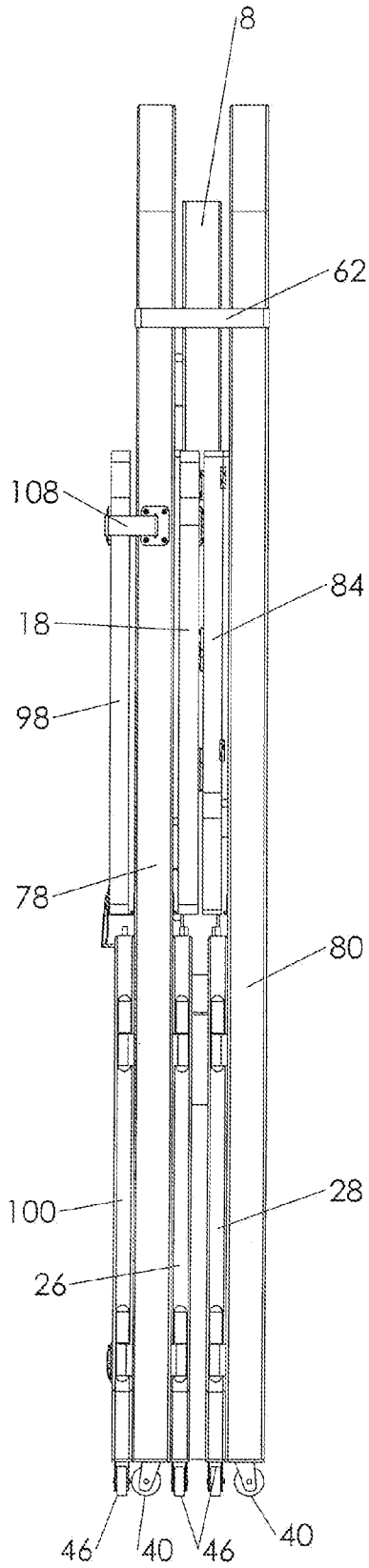
FIG. 21 is an end view of the second embodiment in the closed position.

FIGS. 19 to 21 are views of the workstation 76 in a closed position. In FIG. 19, there is shown a perspective view of the workstation 76 when viewed from outside the wall 78. FIG. 20 is a top view of the workstation 76 and FIG. 21 is an end view of the workstation 76 when viewed from an end opposite to the elongated member 8. Fasteners 108 hold the second work surface 98 in the folded position substantially parallel to the wall 78. Fasteners 110 hold the horizontal supports 100, 102 against the outer surface of the wall 78 substantially parallel to that wall. The horizontal support 106 is stored against the wall 78 by fastener 112. The same reference numerals are used in FIGS. 19 to 21 as those used in FIGS. 13 to 18, for those components that are identical.

In FIGS. 22 to 25, the second embodiment 76 is shown in a partially open (or it could be stated as a partially closed) position.

Figure 22:
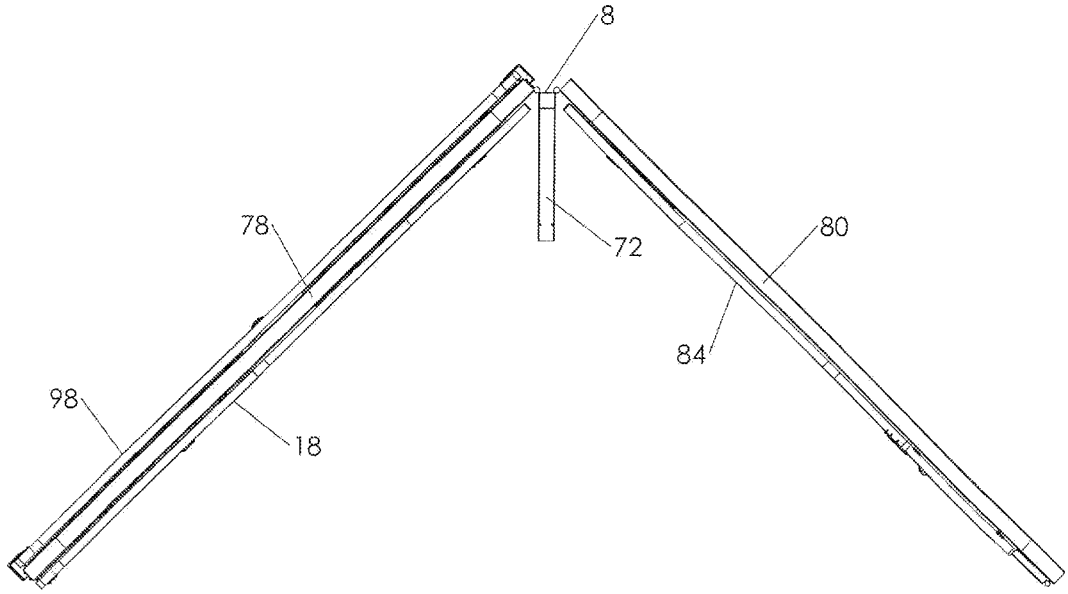
FIG. 22 is a top view of the second embodiment in a first partially open position.
Figure 23:
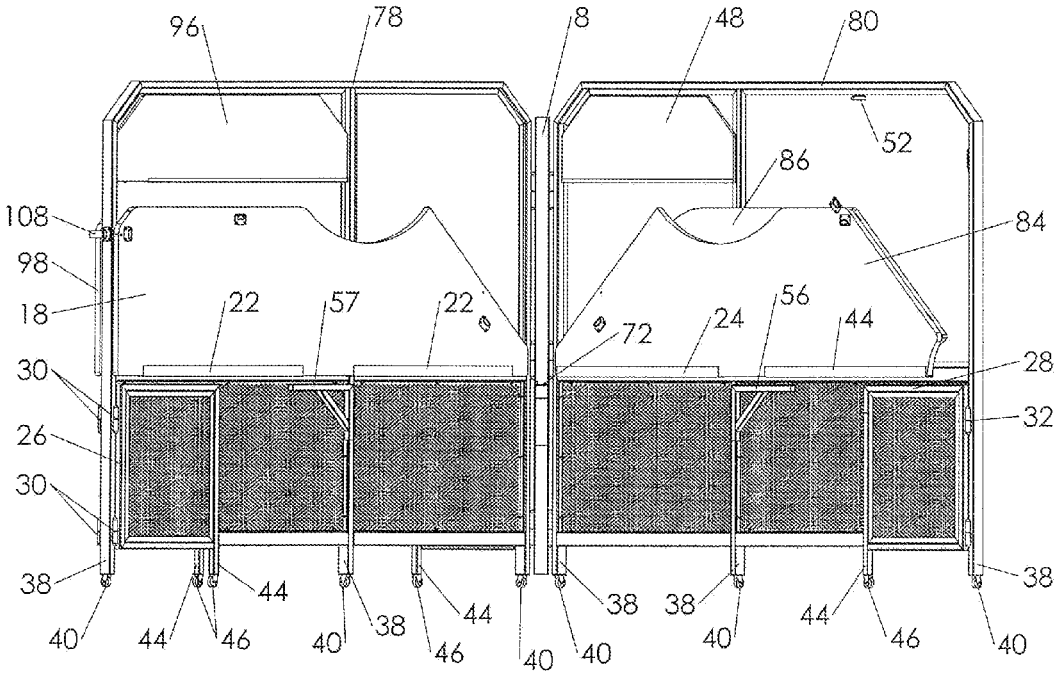
FIG. 23 is a front view of the second embodiment of FIG. 22.

FIGS. 22 and 23 are top and front views respectively (note that the bottom of FIG. 23 is cut off) of the second embodiment 76 in which the walls 78, 80 are less than 90 degrees apart from one another, the work surface 82, sections 18, 84 and the peninsula 86 are in a folded position as is the work surface 98 and all are substantially parallel to the walls 78, 80 to which they are connected. The peninsula 86 is folded behind the section 84 on the hinges 92. The fastener 108 is in place to retain the work surface 98 against the outer surface of the wall 78. Fasteners to retain the section 18 on the section 84 and peninsula 86 are not shown in FIGS. 22 and 23. The shelves 48, 96 are also in the folded position as are the horizontal supports 26, 28, 57, 56.

Figure 24:
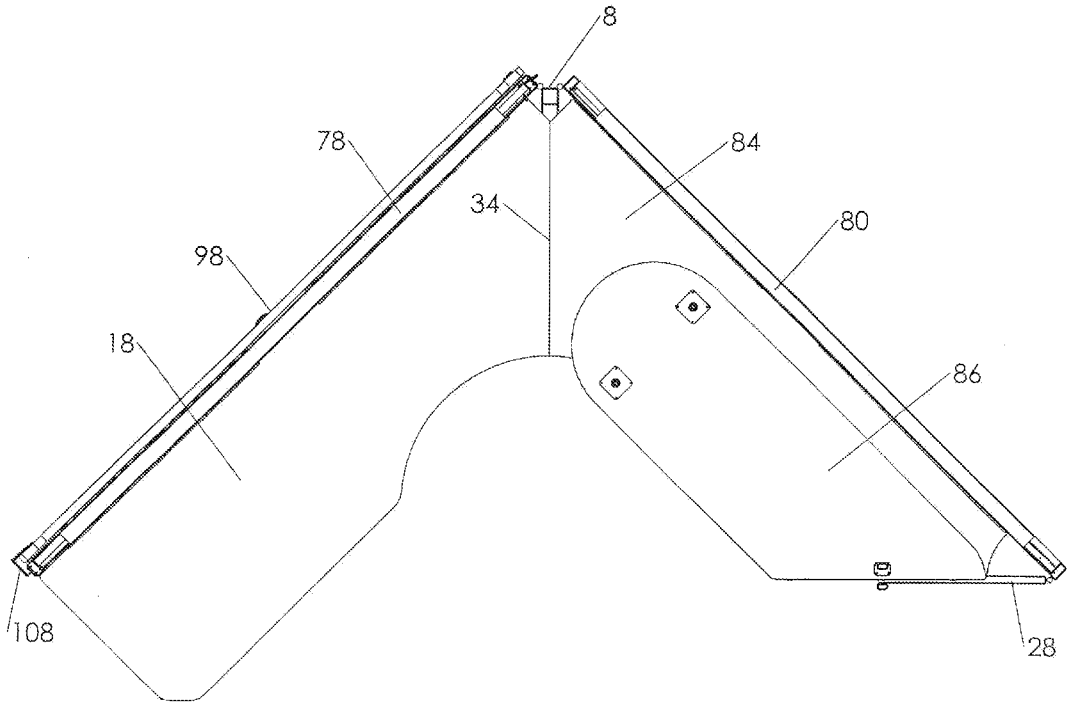
FIG. 24 is a top view of the second embodiment in a second partially open position.
Figure 25:
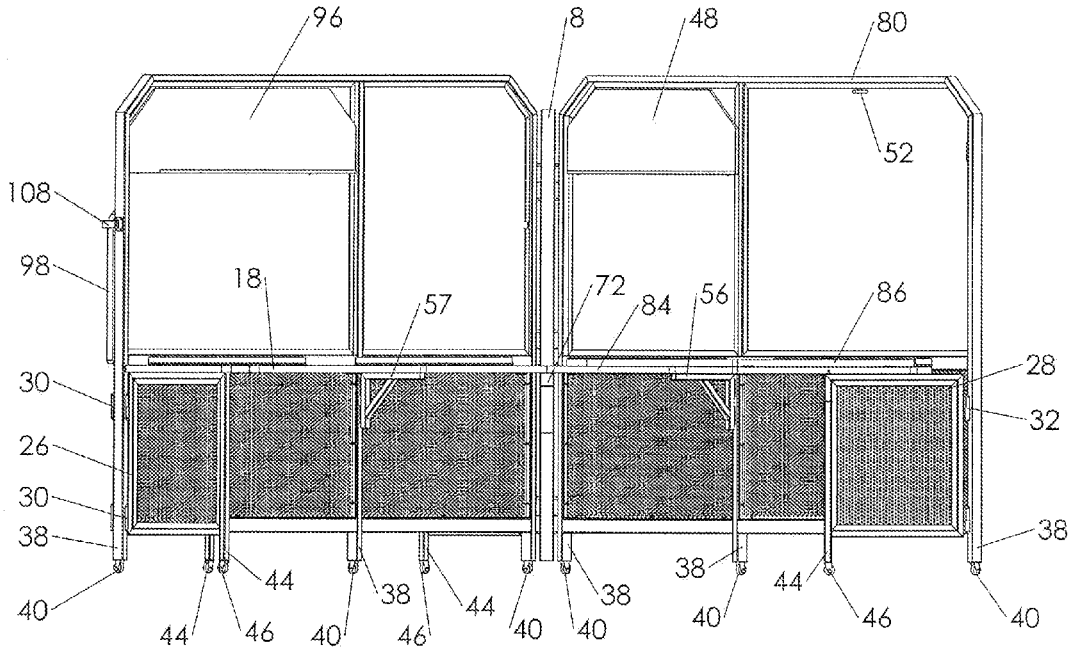
FIG. 25 is a front view of the second embodiment shown in FIG. 24.

In FIGS. 24 and 25, there is shown a top view and front view of the workstation 76 in which the walls 78, 80 are 90 degrees apart from one another and the work surface 82 has sections 18, 84 in the horizontal position resting on the horizontal supports 98, 100, 56, 57, with the peninsula 86 pivoted and resting upside down on the section 84. The legs 88 of the peninsula 86 have been folded inward. Except for those changes, the workstation 76 shown in FIGS. 24 and 25 is the same as the workstation 76 shown in FIGS. 22 and 23. (The legs 88 are not shown in FIG. 25). The lamp 42 is not shown in FIGS. 22 to 25. Alternatively, though not shown, the legs 88 of the peninsula 86 can be removable in lieu of being foldable and can be stored in a bottom portion of one of the walls.

By comparing the workstation 2 with the workstation 76, it can be seen that the walls of the workstation 76 have essentially the same height throughout their length whereas the walls of the workstation 2 decrease in height toward a free end of the walls. The workstation 76 has two foldable shelves whereas the workstation 2 has only one foldable shelf. The workstation 76 has a peninsula and what would be the component 20 of the work surface 14 has a different shape, because of the peninsula, as can be seen from FIG. 13. The workstation 76 also has a second work surface 98 located outside of the wall 78. From these variations, it will be readily apparent to those skilled in the art the numerous additional variations can be made within the scope of the attached claims. When comparing the length of the workstation 2 in the closed position compared to the length as shown in FIG. 8, the workstation 2 is longer than it is wide by a factor of greater than 11. The embodiment 76 shown in FIG. 20 is wider than component 2 because of the second work surface 98 on the outside of the wall 78, but the length exceeds the width by a factor of more than 10.

More or fewer shelves can be installed on the embodiments, the walls can have a different shape from the shapes shown. Preferably, the shape of the two walls are identical to one another but designs can be made where the two walls have a non-identical shape. The work surface on the inner walls can also have a different shape from that shown in the workstations 2, 76. While the work surface connected to one of the walls preferably is shaped to meet the workstation connected to the other wall along an imaginary line, the two work surfaces can be separate from one another. In addition, a third work surface can be installed outside the wall 80 and that work surface can have a different shape than the work surface 98. The work surface outside the walls can have a peninsula hingedly connected to it.

The long and narrow footprint of the workstations when they are in a closed position compared to the large footprint when the workstations are in an open position results in very reasonable transportation costs as numerous workstations can be transported in the same truck. The workstation can be mounted on at least one of wheels or casters to assist in transporting the workstation and also to assist in installing or collapsing the workstation. Preferably, the wheels or casters are retractable.

However, the workstations can be manufactured without wheels or casters and can have Teflon (a trade mark) adjustable levelling glides. In some office environments, the casters may not be acceptable aesthetically. The workstations are light enough that typical mover/material handling equipment can be used to move workstations when no casters or wheels are used.

Another advantage of the present invention is that there is little packing material required during shipping. Each workstation can be wrapped in a reusable protective cover for shipping. 4-6 units are bound together for stability and placed on a pallet in the upright position. This creates a minimal amount of packaging materials for disposal. No tools are required to install or remove the workstation.

I claim:

1. A portable workstation that can be installed in or removed from a work area by one person, said workstation comprising two walls that are hingedly connected to either side of an elongated member, said workstation having a foldable work surface with horizontal supports being hingedly connected to said two walls:

said workstation having two sections, a first section of said two sections being hingedly connected to one of said two walls, and a second section of said two sections being hingedly connected to the other of said two walls, the two sections being shaped and mounted to fit together at the same level when unfolded, the two sections each having an inner edge, the inner edges meeting to form a common boundary when the two sections are unfolded;

in a closed position, said two walls being substantially parallel to one another with said work surface being folded in an orientation substantially parallel to said two walls and being between said two walls, said horizontal supports also being folded to be substantially parallel to said two walls and being between said two walls, said workstation being fastened in the closed position;

in an operating position, said two walls being released from said closed position and being oriented substantially ninety degrees to one another, said horizontal supports for said work surface being pivoted away from the wall of said two walls to which they are connected to a position to support said work surface, said work surface being unfolded to rest upon said horizontal supports.

2. A portable workstation that can be installed in or removed from a work area by one person, said workstation comprising two walls that are hingedly connected to either side of an elongated member, said workstation having a foldable work surface with horizontal supports being hingedly connected to at least one of said two walls, said work surface having two sections, a first section of said two sections being hingedly connected to one of said two walls and a second section of said two sections being hingedly connected to the other of said to walls, the two sections being shaped and mounted to fit together to form the work surface when unfolded:

in a closed position, said two walls being substantially parallel to one another with said work surface being folded in an orientation substantially parallel to said two walls and being between said two walls, said horizontal supports also being folded to be substantially parallel to said two walls and being between said two walls, said workstation being fastened in the closed position;

in an operating position, said two walls being released from said closed position and being oriented substantially ninety degrees to one another, said horizontal supports for said work surface being pivoted away from the wall of said two walls to which they are connected to a position to support said work surface, said work surface being unfolded to rest upon said horizontal supports.

3. A portable workstation as claimed in claim 2 wherein said horizontal supports are hingedly connected to both of said two walls, with one or more said horizontal supports being connected to one of said two walls to support said first section and one or more of said horizontal supports being connected to the other of said two walls to support said second section.

4. A portable workstation as claimed in claim 1 wherein said horizontal supports are hingedly connected to both of said walls and are located to support each section of said work surface.

5. A portable workstation as claimed in claim 4 wherein said two sections of said work surface meet alone a common imaginary line.

6. A portable workstation as claimed in claim 5 wherein said common imaginary line is linear and extends at an angle between said two sections.

7. A portable workstation as claimed in claim 6 wherein said imaginary line is located at a forty-five degree angle to a longitudinal axis of each section.

8. A portable workstation as claimed in claim 1 wherein there is at least one foldable shelf with at least one support to hold said at least one foldable shelf in a horizontal position when said at least one shelf is in said operating position.

9. A portable workstation as claimed in claim 8 wherein said workstation has a latch and catch to hold said two walls together when said workstation is in a closed position.

10. A portable workstation as claimed in claim 8 wherein said workstation and said at least one shelf in a position substantially parallel to said two walls when said station is in a closed position or in an operating position.

11. A portable workstation as claimed in claim 1 wherein, in said closed position, said workstation having a footprint that is substantially long and narrow with said length being longer than said width by at least a factor of five.

12. A portable workstation as claimed in claim 11 wherein said factor is at least a factor of ten.

13. A portable workstation as claimed in claim 1 wherein there is a foldable peninsula one end of said work surface, said peninsula extending inward from the wall of said two walls to which it is hingedly connected, a free end of said peninsula being supported by a foldable leg.

14. A portable workstation as claimed in claim 13 wherein said peninsula meets said end of said work surface along a common line.

15. A portable workstation as claimed in claim 1 wherein the two walls have at least one of wheels or casters spaced along a bottom thereof.

16. A portable workstation as claimed in claim 15 wherein the walls have legs thereon and the wheels or casters are located at the base of each leg.

17. A portable workstation as claimed in claim 1 wherein there is a horizontal support mounted on said elongated member to support said work surface.

18. A portable workstation as claimed in claim 17 wherein there are at least two horizontal supports hingedly mounted on each wall to support said work surface.

19. A portable workstation as claimed in claim 18 wherein one of said horizontal supports is located at an end of each wall and has a wheel or caster at a base thereof.

* * * * *